United States Patent [19]

Irvine et al.

[11] 4,360,106

[45] Nov. 23, 1982

[54] DISPLAY MOUNTABLE CONTAINER HAVING RECLOSEABLE FEATURE

[75] Inventors: James E. B. Irvine, North Plainfield; J. Roy Parcels, Columbus, both of N.J.

[73] Assignee: Youngs Drug Products Corporation, Piscataway, N.J.

[21] Appl. No.: 253,237

[22] Filed: Apr. 13, 1981

[51] Int. Cl.[3] ..... B65D 5/54; B65D 5/02

[52] U.S. Cl. ..... 206/621; 206/626; 206/470; 206/806; 206/631; 229/37 R

[58] Field of Search ..... 206/621; 229/44, 37 R, 229/16 D; 206/470, 626, 631, 806, 461

[56] References Cited

U.S. PATENT DOCUMENTS

| | | | |
|---|---|---|---|
| 2,680,558 | 6/1954 | Mai | 206/631 |
| 3,366,311 | 1/1968 | Simpson | 206/631 |
| 4,266,671 | 5/1981 | Roccaforte | 206/626 |
| 4,291,807 | 9/1981 | Giordano | 206/626 |

*Primary Examiner*—William Price
*Assistant Examiner*—Brenda J. Ehrhardt
*Attorney, Agent, or Firm*—Arthur B. Colvin

[57] ABSTRACT

The present invention is directed to a package or container made of folded cardboard or the like and more particularly to a container intended to be used in conjunction with a marketing display rack. The container is characterized in that the same is provided with a reinforced support member which reduces the likelihood of the container being inadvertantly separated from the point of purchase display. Removal of the element providing the support feature also functions to open the package. Means are created as a result of the removal of the supporting portions for subsequent reclosing of the container.

3 Claims, 12 Drawing Figures

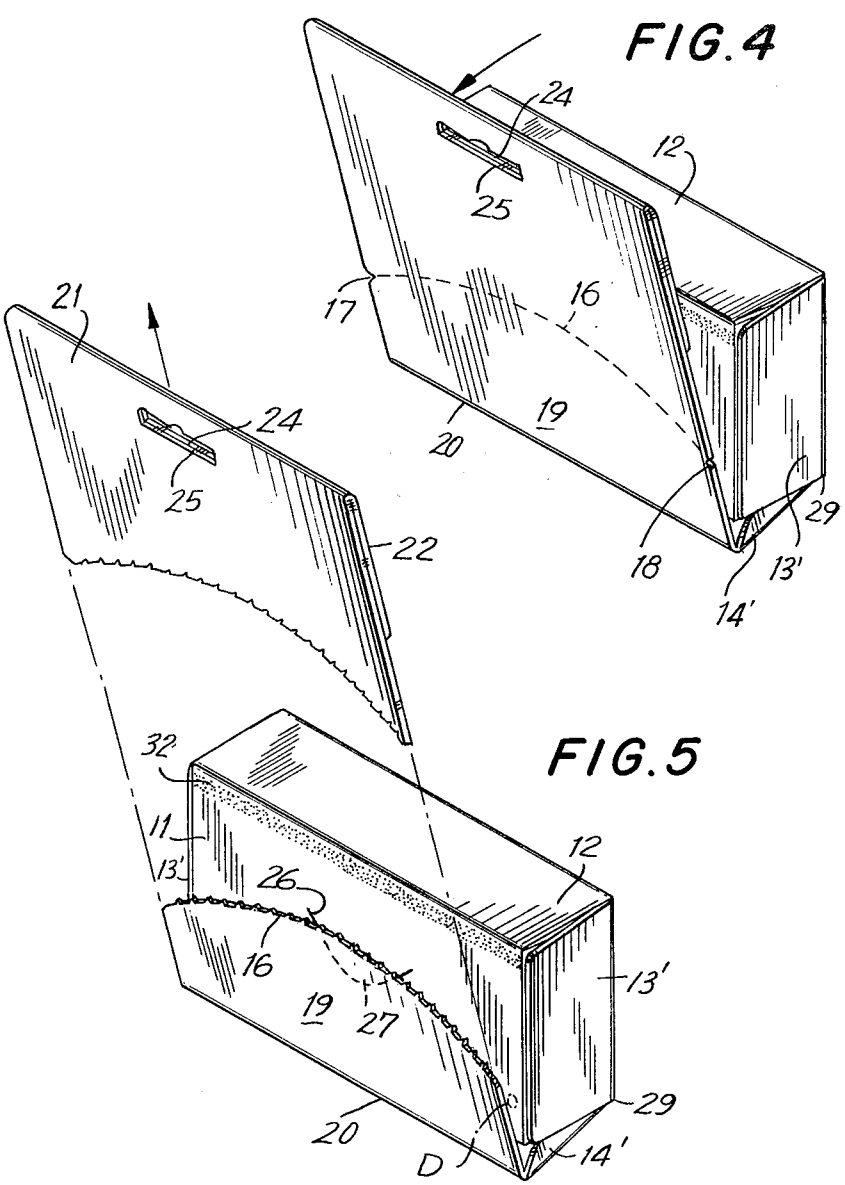
FIG. 4
FIG. 5
12
13'
14'
16
17
18
19
20
21
22
24
25
26
27
29
32
11
D
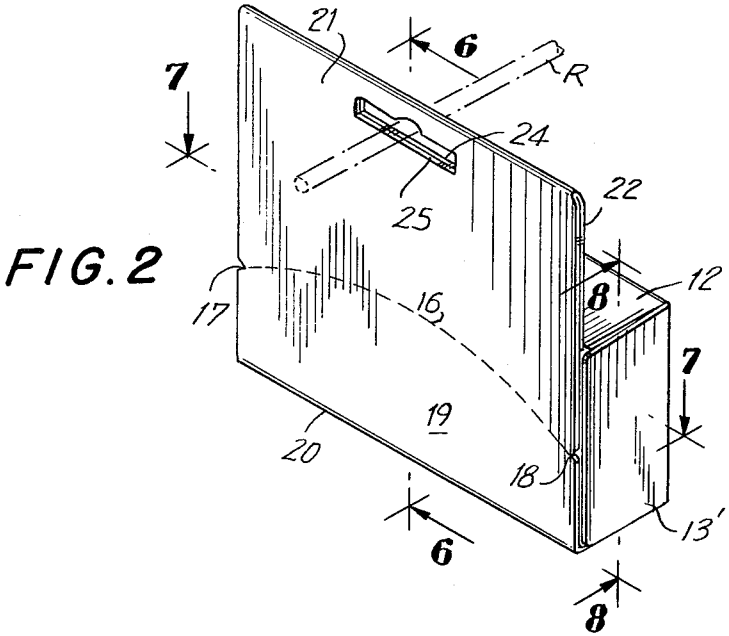
FIG. 2
FIG. 3
6
7
8
R
12
13'
16
17
18
19
20
21
22
24
25
32
11

DISPLAY MOUNTABLE CONTAINER HAVING RECLOSEABLE FEATURE

BACKGROUND OF THE INVENTION

1. Field of the Invention

The present invention is in the packaging field and is directed more particularly to a package made of folded cardboard or like material and adapted to be mounted on a display rack, such as a wire point-of-purchase display rack.

2. The Prior Art

It is conventional to package articles for sale in containers which incorporate, flaps, extensions or like appendages fitted with receiver apertures enabling the packages to be mounted on point-of-purchase displays, such as racks having projecting fingers, rods or loops. It is not uncommon for such packages to be removed from the rack and replaced after a prospective purchase has inspected the product description and like informative material printed on the packages. Where packages are subjected to multiple handlings, the apertured support flap may become worn or torn, leaving the article in a condition no longer to be supportable on the rack and rendering the package soiled or deformed and hence unsaleable.

Since the appendage whereby the package is mounted on a display rack typically projects a substantial distance beyond the article proper, the prospective purchaser will usually be required to undertake two operations in utilizing and storing the package, namely, tearing off the appendage to render the package more compact, and opening the package to gain access to the contents.

Additionally, where the nature of the article is such that the entire contents of the package are not used directly after opening, it is desirable that the container be recloseable.

The operation of opening packages of the aforementioned type as heretofore known has resulted in removal of printed portions of the container. In order to avoid exposing unprinted areas, manufacturers have resorted to printing both faces of the blank from which the package is fabricated, a procedure which substantially increases costs.

SUMMARY OF THE INVENTION

The present invention may be summarized as directed to an improved display package, the term "display packing" being used hereinafter to connote a package which functions both to enclose the articles vended and also to provide means for supporting the same on a display rack or the like.

The package, which is generally in the form of a rectangular parallelepiped, includes top, bottom, front and rear walls and side closures, and is characterized in that a rear panel member defining an upward extension of the bottom wall portion of the container outwardly laps the rear wall of the container.

The rear panel member is folded transversely, to define a single thickened section which outwardly laps the rear wall and a double thickness area projecting above the top wall of the container. The double thickness area is joined to the rear wall along an adhesive line adjacent the top of the container.

The single thickness section of rear panel is divided into two parts along a score line. An aperture is formed in the double thickness portion of the rear panel, enabling the same to be mounted on a display rack with the wire component of the rack extending through a reinforced portion of the article.

To open the package, the rear panel is ripped in two along the score line, an operation which automatically separates the adhesive line connecting the removable portion of the panel to the rear wall of the container. This single operation provides access to the interior of the package by pivoting the bottom wall and remaining portions of the back panel upwardly.

The package may thereafter be reclosed by sleeving the tab portion formed as a result of severing the back panel along the score line, into the interior of the container in the space defined between the bottom wall and the rear panel.

Optionally but preferable, the back panel may be slit to define a tongue, within which the tag is engageable in the reclosed position to maintain the device in its reclosed condition.

It is accordingly an object of the invention to provide an improved display package.

A further object of the invention is the provision of a display package of the type described which affords a durable connection to the display rack and which, upon removal of the component or extension connecting the package to the display rack, functions also to open the package.

Still a further object of the invention is the provision of a display package of the type described which may be readily reclosed after initial opening and which will remain dependably in the reclosed condition.

Still a further object of the invention is the provision of a display package of the type described wherein all printing is effected solely on one face of the package and which, after opening and reclosing, will present to view only elements of the imprinted face.

To attain these objects and such further objects as may appear herein or be hereinafter pointed out, reference is made to the accompanying drawings, forming a part hereof, in which:

FIG. 2 is a perspective view of a finished container in accordance with the invention;

FIG. 3 is a view similar to FIG. 2 illustrating one mode of opening the container;

FIG. 4 is a view similar to FIG. 2 showing another mode of opening the container;

FIG. 5 is a perspective view of a opened container;

Figure 1:
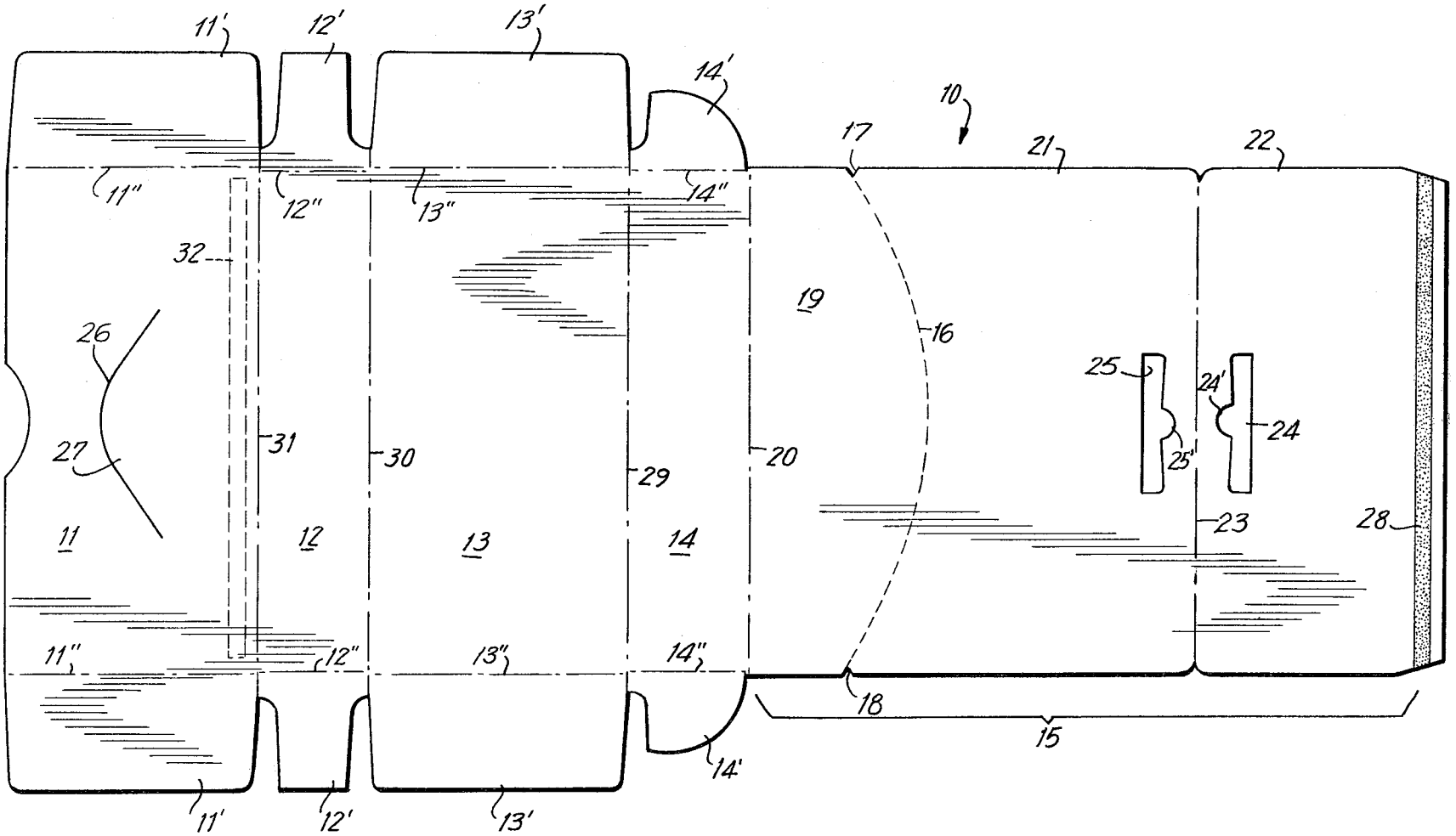
FIG. 1 is a plan view of a box blank for fabricating a container in accordance with the invention.
Figure 8:
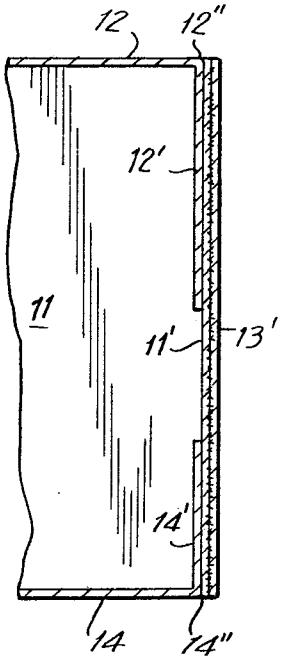
FIG. 8 is an enlarged vertical sectional view taken on the line 8—8 of FIG. 2.
Figure 7:
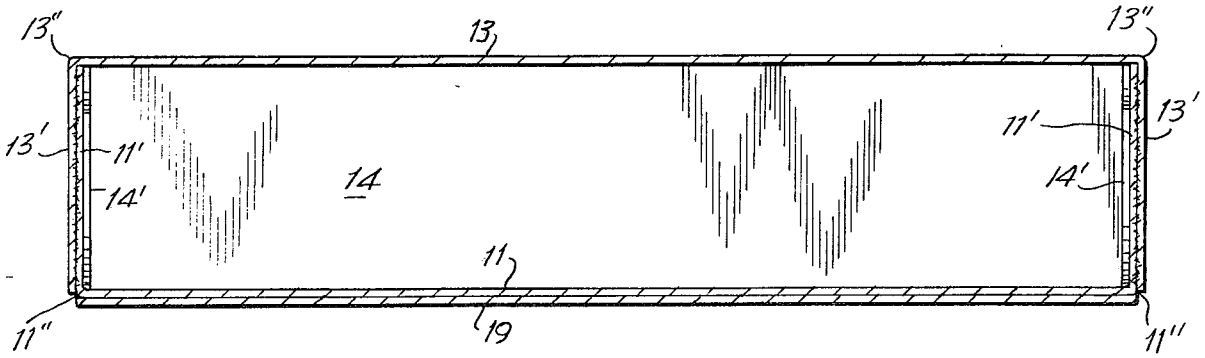
FIG. 7 is an enlarged horizontal sectional view taken on the line 7—7 of FIG. 2.
Figure 6:
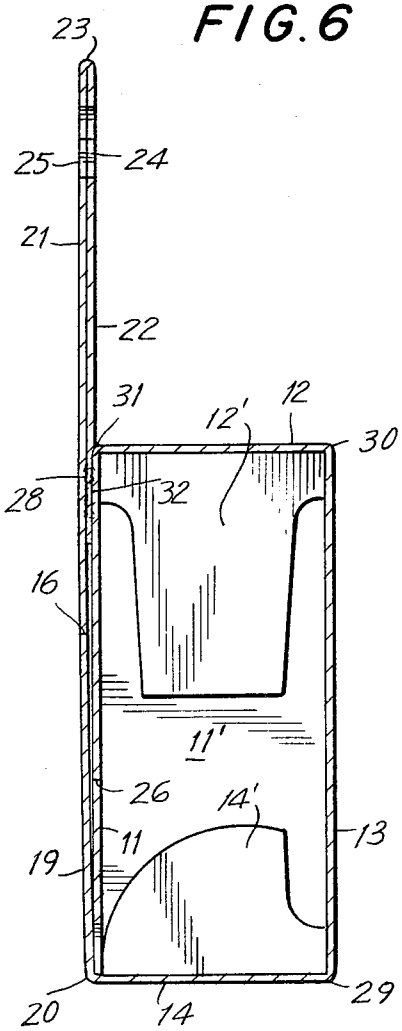
FIG. 6 is an enlarged vertical sectional view taken on the line 6—6 of FIG. 2.
Figure 11:
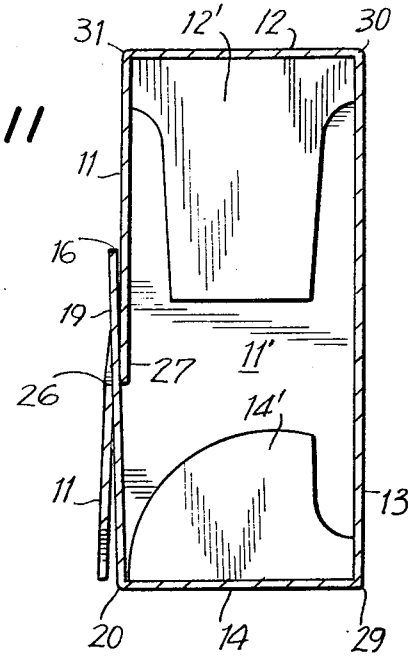
FIG. 11 is an enlarged vertical sectional view taken on the line 11—11 of FIG. 10.

Turning now to the drawings, there is shown in FIG. 1 a blank 10 of cardboard or the like from which a package in accordance with the invention is fabricated. The blank is comprised generally of a rear wall portion 11, a top wall section 12, front wall portion 13, bottom wall portion 14 and rear panel assembly 15.

A pair of side ears 14', 14' extend laterally from the bottom wall portion 14, being separated therefrom by weakened score lines 14". In similar fashion, side flaps 13', 13' extend outwardly of and are separated from the front wall portion 13 by score lines 13". Similarly, edge flaps 12', 12' and side flaps 11', 11' extend from top wall 12 and rear wall 11, respectively, the flaps in each instance being separated from the wall portions by score lines 12" and 11", respectively.

The rear panel 15 incorporates a transverse arcuate perforation line 16, for purposes which will appear hereinafter. Optionally but preferably, the terminal ends of the perforation line 16 are formed with notches 17, 18 to facilitate tearing along the score line 16. The perforation line 16 thus defines a tab section 19 which is connected to the bottom wall portion 14 along a first scored fold line 20.

The rear panel member 15 includes, in addition, a second section 21 and a third section 22, the sections 21 and 22 being separated by a second scored fold line 23.

A pair of support apertures 24, 25 are formed in the blank as mirror images symetrically about the fold line 23.

Additionally, the rear wall portion 11 is provided with a slit 26 generally in the form of a broad V, defining a tongue portion 27.

It will be understood that the upwardly directed surface of the blank as viewed in FIG. 1 will form the inside of the package, and that any printed material, directions for use, advertising, etc., will appear on the bottom face, i.e. the face away from that viewed in FIG. 1.

Figure 12:
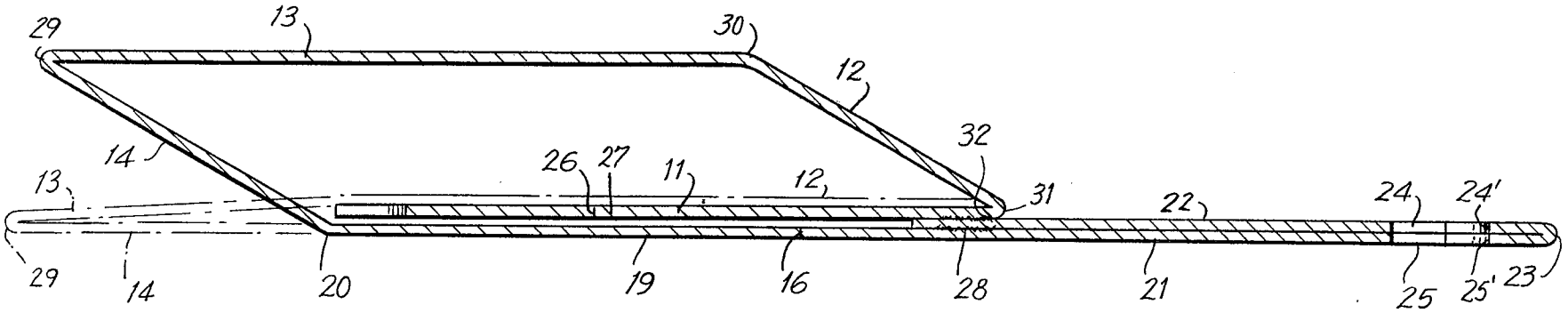
FIG. 12 is a sectional view of the blank in a partially assembled condition.

The blank depicted in FIG. 1 is used by partially assembling the same to a box preform as depicted in FIG. 12, which preform may be packaged in bulk in flatwise condition for subsequent assembly in a conventional box filling and forming apparatus such as is known in the trade as a Jones filling machine.

More particularly and with references to FIGS. 1 and 12, the preform is fabricated by folding the section 22 of the rear panel forwardly (toward the viewer) about the fold line 23 through 180° and effecting a transverse adhesive line of connection 28 between the rear panel sections 21 and 22. Thereafter the blank is folded along scored lines 29 and 31 to the configuration shown in FIG. 12 and a further adhesive connection 32 effected between the undersurface of section 22 (e.g. the surface not shown in FIG. 1) and an area of the rear wall portion 11 adjacent fold line 31.

As will be apparent from an inspection of FIG. 12, after the formation of the adhesive connections 28 and 32, the box preforms may be flattened as for shipment to a filling station where they may be erected to a three dimensional configuration which is generally a rectangular parallelepiped. The preforms as shown in FIG. 12 are next filled and sealed in a manner known per se and forming no part of the present invention.

Briefly, the filling sequence includes the steps of first deflecting the wall portions of the preforms to the parallelepiped configuration, folding the ears and edge flaps at one side of the package at 90° to the plane of the blank along fold lines 14" and 12", respectively, thereafter inwardly folding side flaps 11 and 13 into mutually overlapping condition, and gluing one said side flap over the other.

Thereafter, the partially closed but three dimensional package is filled from the open end, following which the unsealed end of the box is closed, and glued utilizing the same sequence of inwardly bending the remaining side ear and edge flap and inwardly folding and gluing the remaining side flaps 11' and 13'.

Following the last mentioned step, the package is completely formed and ready for application to a merchandising apparatus, such as a display rack.

Typically, the dispensing rack, which forms no part of the present invention, may comprise a stanchion having a series of rods R extending therefrom, (FIG. 2).

The aligned apertures 24, 25 may include semicircular notches 24', 25' at upper portions, thereof facilitating mounting of the package where the dispensing arm is, as noted, rod shaped. Alternatively, the dispensers may comprise a length of wire bent upon itself and defining a bight having two legs which are parallel and spaced apart, in which event it will be appreciated that the wire components of such dispenser will be in spaced relation within the apertures 24, 25.

It will be readily recognized that the connection between the package device and the dispensing apparatus is afforded by a double layer of cardboard, whereby the likelihood of tearing during handling is substantially reduced.

A principal feature of the invention lies in the manner in which it may be readily opened for use, the action of opening in addition functioning to remove the portions of the back panel which previously served as the medium for supporting the device on the dispenser rack.

Referring now to FIGS. 3, 4, and 5, the package is opened by removing the rear panel sections 21 and 22. Such removal may be effected in one of two manners.

As shown in FIG. 3, the panel sections 21, 22 may simply be peeled back, severing the sections from the remainder of the rear panel along the score line 16 and simultaneously rupturing the adhesive connection 32 which secures section 22 to rear wall portion 11.

Alternatively, the adhesive connection 32 may first be fractured as shown in FIG. 4, and thereafter the section 21 separated from section 19 along score line 16, as illustrated in FIG. 5.

As will be evident, either of the two opening operations will leave the contents accessible by simply pivoting the bottom wall portion 14 (which now, in effect, defines the top of the container) outwardly along fold line 29, providing access to the interior.

Figure 10:
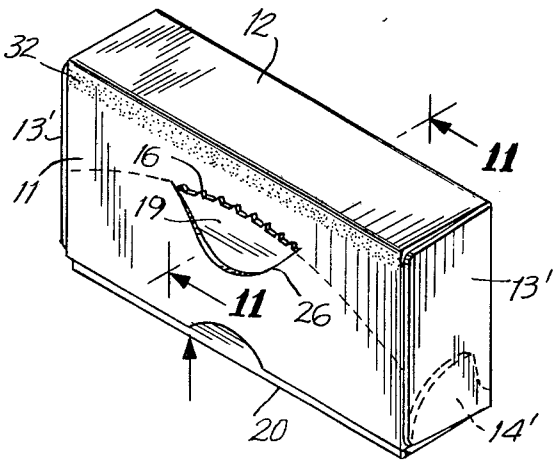
FIG. 10 is a perspective view showing the position of the parts after reclosing of the package.
Figure 9:
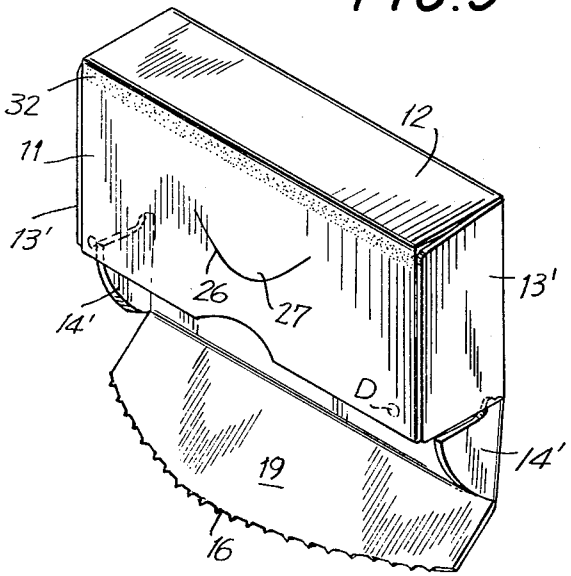
FIG. 9 is a further perspective view of the opened package.

In order to reclose the container, it is merely necessary to tuck the remaining portion of the rear panel, namely the tab shaped section 19, into the interior of the container into a position essentially parallel with the rear wall portion 11 thereof. Preferably the tab is inserted through the slit 26, whereby a frictional resistance to reopening of the packaged is obtained—see FIG. 10.

As will be evident from the preceding description, there is shown and described herein an improved box, container or receptacle particularly adapted for use in conjunction with merchandising apparatus having projecting rods or fingers. It will be noted that the container provides a double thickness of material riding on the support rods or fingers, whereby the likelihood of tearing, rendering the package unsuitable to be maintained on the dispenser, is substantially lessened.

It will further be appreciated that the components of the container which previously functioned to maintain the device on a merchandising display, when peeled away in the manner aforesaid, provide access to the contents of the package simultaneously with the removal of the surplus material.

After opening, the package may readily be reclosed by tucking the portion of the back panel remaining through the open mouth of the container into juxtaposition with the rear wall of the container.

It will be further understood that all printing is effected on only one surface of the blank forming the container and that both before and after the removable portions of the back panel are separated, only those components which were on the printed surface of the blank are exposed to the exterior of the container.

As will be apparent to those skilled in the art and familiarized with the instant disclosure, numerous variations may be made in the details of construction of the illustrated embodiment of the invention and, accordingly, the invention is to be broadly construed within the scope of the appended claims.

We claim:

1. A reclosable package comprising an integral blank printed on one face, said package including an enclosed space in the general shape of a rectangular parallelepiped defined by front, rear, top and bottom walls, having said one face directed outwardly, each of said front and top walls being joined to others of said walls along two parallel fold lines, said rear wall being connected to said top wall along a single fold line and having a downwardly directed free edge, a rear panel member joined to said bottom wall along a first fold line coincident with the rear margin thereof, said rear panel extending upwardly parallel to said rear wall and therebeyond, a slit formed in said rear wall defining a tongue including a tip directed toward said bottom wall, said rear panel being folded forwardly toward said rear wall along a second line parallel to said first fold line to define a depending tab interposed between said rear wall and the wall adjacent face of said panel, the end margin of said tab terminating at a level along said rear wall above said bottom wall, registering rack retainer apertures formed in said tab and back panel to define a double thickness mounting support for engagement with a display rack, an adhesive connection formed between said tab and said rear wall and a score line formed across said panel at a position between said adhesive line and said bottom wall whereby said package may be opened by separating said adhesive line and may be reclosed by severing said panel along said score line and inserting the remaining portions of said panel into the space defined between said bottom wall and said rear wall, said tab in said reclosed condition of said package being disposed within said slit with said tongue, engaging one surface of said tab and said rear wall engaging the other surface of said tab, thereby frictionally to retain said tab in said reclosed position.

2. A package in accordance with claim 1 including flaps on the ends of said front and rear walls defining end closures of said package, the combination including ears extending from and perpendicular to said bottom wall, said ears, in the closed and reclosed conditions of said package being frictionally engaged against said flaps.

3. A package in accordance with claim 2 wherein said score line is arcuate.

* * * * *